US008245560B2

(12) United States Patent
Battenfeld et al.

(10) Patent No.: US 8,245,560 B2
(45) Date of Patent: Aug. 21, 2012

(54) CRIMPING PLIERS

(75) Inventors: Kurt Battenfeld, Ebsdorfergrund (DE); Thomas Glockseisen, Düsseldorf (DE)

(73) Assignee: WEZAG GmbH Werkzeugfabrik, Stadtallendorf (DE)

( * ) Notice: Subject to any disclaimer, the term of this patent is extended or adjusted under 35 U.S.C. 154(b) by 340 days.

(21) Appl. No.: 12/350,375

(22) Filed: Jan. 8, 2009

(65) Prior Publication Data

US 2009/0183547 A1 Jul. 23, 2009

(30) Foreign Application Priority Data

Jan. 22, 2008 (DE) ..... 10 2008 005 472

(51) Int. Cl.
*B21D 37/14* (2006.01)

(52) U.S. Cl. ..... 72/409.16

(58) Field of Classification Search ..... 72/120, 72/121, 402, 409, 416, 409.16, 412, 413; 81/100, 182, 349, 315, 317, 342, 345, 393, 81/446, 478

See application file for complete search history.

(56) References Cited

U.S. PATENT DOCUMENTS

| | | | | |
|---|---|---|---|---|
| 2,654,282 | A | 10/1953 | Emmett | |
| 3,101,017 | A * | 8/1963 | Buchalter et al. | 72/409.01 |
| 3,359,779 | A * | 12/1967 | Filia | 72/412 |
| 4,433,569 | A * | 2/1984 | Santinelli | 72/409.01 |
| 5,187,968 | A | 2/1993 | Beetz et al. | |
| 5,735,353 | A | 4/1998 | Undin | |
| 5,758,729 | A | 6/1998 | Undin | |
| 5,913,933 | A | 6/1999 | Beetz et al. | |
| 5,937,505 | A * | 8/1999 | Strong et al. | 29/593 |
| 6,026,671 | A | 2/2000 | Battenfeld | |
| 6,286,358 | B1 | 9/2001 | Beetz et al. | |
| 6,474,130 | B2 | 11/2002 | Battenfeld | |
| 7,155,954 | B2 | 1/2007 | Battenfeld | |

FOREIGN PATENT DOCUMENTS

| | | | |
|---|---|---|---|
| DE | 197 09 639 | A1 | 9/1998 |
| DE | 198 34 859 | C2 | 1/2001 |
| DE | 199 63 097 | C1 | 4/2001 |
| DE | 101 40 270 | B4 | 9/2004 |
| DE | 1 275 490 | A1 | 2/2009 |
| EP | 0 096 328 | A1 | 5/1983 |
| EP | 1 941 975 | A2 | 7/2008 |
| GB | 1 095 683 | | 12/1967 |
| NL | 6 610 913 | | 2/1967 |
| WO | 01-23146 | A1 | 4/2001 |

OTHER PUBLICATIONS

European Search Report of co-pending, related European Patent Application No. EP 09150149.4, mailed 047/24/2009.

* cited by examiner

*Primary Examiner* — Edward Tolan
*Assistant Examiner* — Homer Boyer
(74) *Attorney, Agent, or Firm* — Thomas, Kayden, Horstemeyer & Risley, LLP

(57) ABSTRACT

The present invention relates to crimping pliers designed and arranged for manually crimping a work piece. Such crimping pliers comprise two manually operated hand levers coupled by a transfer mechanism with two crimping jaws. A closing mechanism is designed and arranged for being operated independent on said hand levers. Upon activation of the closing mechanism the crimping jaws are moved from an open state in a partial movement in a further closed starting state. The crimping jaws are secured in the starting state against returning into said open state. Starting from said starting state the crimping jaws are movable in an additional partial movement towards each other upon manipulation of the hand levers.

20 Claims, 8 Drawing Sheets

CRIMPING PLIERS

CROSS REFERENCE TO RELATED APPLICATIONS

This application claims priority to co-pending German Patent Application No. DE 10 2008 005 472.0 entitled "Presszange", filed Jan. 22, 2008.

FIELD OF THE INVENTION

The present invention generally relates to crimping pliers for manually crimping a work piece, in particular a holder, a contact element, a fitting, conduits or pipes, cable lugs and the like.

BACKGROUND OF THE INVENTION

A plurality of crimping pliers exists with a lot of different embodiments with different transmission mechanisms for the force between the hand levers and the crimping jaws. The design of such crimping pliers depends on the need of producing large crimping forces with limited forces applied by the users upon the hand levers. Furthermore, the crimping pliers should be useable in a comfortable and economic way.

Crimping pliers for manually crimping a work piece are known from German Patent No. DE 199 63 097 C1 corresponding to U.S. Pat. No. 6,474,130 B2 of the applicant. These crimping pliers comprise two manually activated hand levers. The movement of the hand levers and forces applied upon the hand levers are transferred by a transmission mechanism having a suitable transmission ratio.

German Patent Application DE 1 275 490 A corresponding to U.S. Pat. No. 3,101,017 A discloses tongs having two hand levers wherein a pivoting movement of the hand levers results in a pivoting movement of a cam disc. The cam disc activates a toggle lever mechanism being linked with the jaws of the tongs. By means of a pawl the movement of the cam disc might be locked at the end of a plurality of crimping steps.

OBJECTIVE OF THE INVENTION

It is an object of the present invention to provide crimping pliers having a new transfer or transmission mechanism for forces applied upon the hand levers to the crimping jaws.

Furthermore, it is an object of the present invention to provide new crimping pliers with an improved activation of the crimping jaws in different conditions of use.

SUMMARY OF THE INVENTION

According to the present invention, the crimping pliers are not solely activated via the hand levers. The crimping pliers comprise a closing mechanism that might be activated independent on the hand levers in a state of the crimping pliers with the work piece introduced between the crimping jaws. By manual activation of the closing mechanism the crimping jaws are movable from an open state via a partial movement into a further closed starting state. It is possible that in the starting state there is still a small gap between the work piece and the crimping jaws (or a die held by the crimping jaws). However, it is also possible that the manual activation of the closing mechanism closes a gap between the work piece and the crimping jaws that exists in the open state so that in the starting state the crimping jaws contact the work piece. Accordingly, it is possible that the closing mechanism is responsible for a partial movement without any application of crimping forces to the work piece. However, it is also possible that for the movement caused by the closing mechanism first crimping forces are applied upon the work piece.

The starting state of the crimping jaws builds a stable operating state of the crimping pliers with the work piece located within the crimping jaws. This is due to the fact that in the starting state the crimping jaws are secured against returning into the open state. Accordingly, the crimping jaws and the work piece might build a connection with or without play so that at the end of the closing movement caused by the closing mechanism it is possible to hold the crimping pliers and the work piece only with one or two hands at the crimping pliers.

Starting from the starting state by means of a movement of the hand levers a further partial movement of the crimping jaws is possible. For the pliers according to the invention, a first partial movement of the crimping jaws is caused by the closing mechanism, whereas a second partial movement of the crimping jaws is caused by the hand levers.

According to a further embodiment of the invention, the transfer or transmission mechanism between the hand levers and the crimping jaws has a transmission ratio which is larger than the transmission ratio of the closing mechanism for the transfer of the forces applied by the user upon the hand levers. Such design of the different transmission ratios might be used for an efficient performance of the first partial movement without crimping forces or with small crimping forces but small movements of the activating element of the closing mechanism leading to large movements of the crimping jaws for overcoming a gap between the crimping jaws and the work piece. On the other hand, it is possible to design the transfer or transmission mechanism for the second partial movement with the right transmission ratio for the real crimping process or the end phase of the crimping process with increased crimping forces.

It is also possible that the starting state reached at the end of the activation of the closing mechanism is fixed by a constructive design of the pliers leading to one single defined relative position of the crimping jaws in the starting state. For such an embodiment there is a partial movement between the open state and the starting state with one single predetermined length. However, according to the invention it is also possible that the closing mechanism is used for gaining different starting states, e.g. depending on the dimensions of the work piece. Such different starting states might be predetermined in a plurality of steps such that the amount of the partial movement between the open state and the starting state might be changed in steps depending on the dimensions or the materials of the work piece worked with the crimping pliers. For determining the closing angle or distance of the jaws in the starting state the crimping pliers might have adjusting means. Furthermore, it is possible that there is an automated adaption of the starting state to the dimensions of the work piece located in the crimping pliers. It is also possible that there is a stepless, continuous adaption of the starting state that is reachable via the closing mechanism. According to one embodiment the partial movement towards the starting state is automatically stopped at the instance that the crimping jaws contact the periphery of the work piece or crimping forces applied during the first partial movement exceed a predetermined force level.

A plurality of different starting states might be provided by the closing mechanism by means of different constructions. According to one embodiment there is an adjustable stop element that is responsible for limiting the starting state. A very simple but efficient way of guaranteeing the starting state is given with the use of a locking-, rest- or ratchet-mechanism (in the following "ratchet-mechanism") used as a part of the closing mechanism. For such embodiment a plurality of ratchet levels are passed during the partial movement from the open state to the starting state. These ratchet steps guarantee that a position once reached during the closing movement is not left in opening direction. The starting state might be reached for a contact of the crimping jaws with the outer circumference of the work piece. Such position might be secured in opening direction via the ratchet-mechanism. It is also possible that the distance between adjacent ratchet steps of the ratchet-mechanism determines preferred starting states. For such ratchet-mechanism there might be some play between the crimping jaws and the work piece whereas the forces applied by the closing mechanism are not sufficient for reaching the next crimping step in closing direction.

In the crimping pliers according to the invention any known transfer or transmission mechanism might be used. The inventive concept might be incorporated in crimping pliers independent on the crimping jaws performing a pivoting movement for closing or the crimping jaws being closed in a translational relative movement.

Another embodiment of the invention focuses on the transfer or transmission mechanism. The invention suggests building the transfer mechanism with two toggle levers being linked with each other via a toggle lever joint. The end regions of the toggle levers being located opposite to the end regions linked with the toggle lever joint are respectively pivotably linked with a crimping jaw. For such an embodiment the pivoting movement of the crimping jaws coincides with the movement of the toggle levers during the closing movement.

An activation of the crimping jaw, i.e. a closing movement of the crimping jaws, might require a cam disc. According to the contour of the cam disc a movement of the cam disc displaces the toggle lever joint leading to a closing movement of the crimping jaws. Such embodiment of the invention relies on the finding that the use of a toggle lever mechanism is of advantage for producing large crimping forces. Due to the geometric and kinematic properties the toggle levers build a good transmission for the forces applied by the user. Furthermore, such embodiment uses the cam disc for the force transmission wherein—depending on the outer contour of the cam disc—a further increase of the force on its path towards the crimping jaws is provided. Accordingly, the combination of the toggle lever mechanism and the cam disc builds a "double transmission system". According to the embodiment shown in the present application, a crimping jaw linked with the toggle lever might be pivoted via an activation of the toggle lever during the closing movement. However, it is also possible that the crimping jaw linked with the toggle lever might perform a translational movement for providing a translational closing movement, see the transfer mechanism disclosed e.g. in U.S. Pat. No. 5,758,729 and U.S. Pat. No. 5,735,353. Also a transfer mechanism comprising such translational movement of at least one crimping jaw should be covered by the present invention.

According to another embodiment of the invention, the cam disc is coupled with the ratchet-mechanism so that during the rotational movement of the cam disc different ratchet positions of the ratchet-mechanism are passed. During such movement the reached steps of movement is secured by the plurality of ratchet steps.

Furthermore, the invention suggests connecting the cam disc with an activation element for the transfer of a torsional moment, wherein the activation element is located at the periphery of the crimping pliers or a head of the crimping pliers. The activation element serves for activating the closing mechanism of the crimping pliers. The activation element might be built by an activating lever, wheel, disc or the like, wherein a rotation of the activation element directly or under use of an additional transmission system for further transmission causes a movement of the cam disc. An increase of forces manually applied upon the activation element to an activating torsional moment might be provided by choosing the effective diameter or torque lever of the activation element. However, the activation element might be of any other geometry and having any degree of freedom for the activating movement.

In general, it is possible that the mentioned open state of the crimping pliers is the state with the largest distance of the crimping jaws from each other. However, according to a variant of the invention it is possible to further open the crimping jaws from such stable open state to a loading state. In the loading state it is possible or simplified to introduce a work piece between the crimping jaws. The crimping jaws are moved by manual activation into the loading state. Such embodiment should be explained on the basis of the following example: in case of the work piece being a hollow cylindrical element (as a fitting or conduit or pipe) the crimping jaws might be opened to a loading state so that the crimping jaws build a bit of tongs or mouths with an opening which is larger than a cross dimension of the work piece. Accordingly, it is possible to introduce the work piece transverse to the longitudinal axis of the work piece into the mouth built by the crimping jaws. For the work piece introduced into the mouth in the above described procedure the crimping jaws are transferred from the loading state into the open state. In the open state the mouth built between the crimping jaws has closed to an amount that it is no longer possible to remove the work piece transverse to the longitudinal axis of the work piece through the mouth. Accordingly, for an extreme use of the crimping pliers it is possible that the user gives the work piece out of his hand which is then held (in loose fit) by the crimping pliers in its open state. Furthermore, with the provision of a loading state it is possible to crimp work pieces with larger dimensions than in case of using crimping pliers having only the open state.

According to another embodiment of the invention, in the loading state the crimping jaws are biased by a spring element versus the open state. Accordingly, after having introduced the work piece into the crimping pliers and after removing the manual activation of the crimping jaws in the loading state the spring element is responsible for automatically returning the crimping jaws into the open state.

The movement of the crimping jaws between the loading state and the open state might correlate with a relative movement of the hand levers. However, in case of such relative movement of the hand levers not being desired, it is of advantage to provide some play or gap in the transfer or transmission mechanism between the hand levers and the crimping jaws. Such play or gap is used during the movement of the crimping jaws between the loading state and the open state. It is also possible to provide an additional degree of freedom for decoupling the movement of the crimping jaws and the hand levers for the movement between the loading state and the open state.

Another embodiment of the invention suggests that during the movement of the crimping jaws between the loading state and the open state the toggle lever joint is moved relative to the cam disc. In particular during the movement between the loading state and the open state the contour of the cam disc is approximately directed along the axis of the movement of the axis of rotation of the toggle lever joint. In the region passed during this movement the cam disc does not have a stop element or limiting element for the toggle lever joint. The toggle lever joint slides along the contour of the cam disc, whereas it is also possible that the toggle lever joint separates from the outer contour of the cam disc.

Furthermore, the present invention suggests providing a stop element avoiding an automated closing movement of the crimping jaws further than the open state. For manually introducing the closing movement, such stop element has to be overcome. This might be done by removing, turning or folding the stop element. According to another embodiment of the invention, the stop element might be overcome by a counter element contacting the stop element in the open state being automatically removed with the first activation of the hand levers or the activation element.

Furthermore, it is possible that a spring element is provided biasing the crimping jaws versus the work piece. The spring element might be directly linked with at least one of the crimping jaws. However, it is also possible that the spring element indirectly biases the crimping jaws. E.g. the spring element might bias the transfer or transmission mechanism. In case that the above mentioned stop element secures the open state, in the open state the spring element might be ineffective. However, overcoming the stop element automatically brings the spring element into play wherein the spring element leads to the crimping pliers automatically gripping the work piece between the crimping jaws. Accordingly, the work piece is fixed within the crimping jaws, so that it is also possible to further work only with one hand without gripping the work piece with the other hand. Whereas crimping pliers of the present type usually have an overall length of 60 mm to 90 mm, the present invention also suggests building crimping pliers with an overall length smaller than 400 mm, in particular smaller than 350 mm or 300 mm. Such crimping pliers with decreased dimensions might be used for crimping work pieces also in small spaces, e.g. crimping of conduits or pipes or fittings in air-conditioning units.

According to another embodiment of the invention, the crimping pliers with any length or a length smaller than 400 mm, in particular smaller than 350 mm or 300 mm, is suitable for manually creating crimping forces being larger than 20,000 N, in particular larger than 25,000 N, 30,000 N, 40,000 N, 50,000 N or 60,000 N.

The present invention also suggests providing a forced locking mechanism. A "forced locking mechanism" is a locking unit providing the possibility of performing a closing movement at least for a partial movement of the crimping pliers but securing a reached crimping step so that the crimping jaws remain in their reached position also in case of removing the forces applied to the hand levers and/or the activation element. Furthermore, such force locking mechanism might guarantee that it is not possible to reopen the crimping pliers before reaching a predetermined final crimping step correlating with a defined end state of the crimping pliers. Opening the crimping pliers before reaching such end state might be possible only in extraordinary cases by means of activating an emergency unlocking device. Examples for suitable forced locking mechanisms might be taken from DE 101 40 270 B4, U.S. Pat. No. 5,187,968, U.S. Pat. No. 6,026,671, U.S. Pat. No. 5,913,933, DE 198 34 859 C2, DE 197 09 639 A1 and U.S. Pat. No. 6,286,358.

It is also possible that the crimping pliers are equipped with a locking mechanism. Such "locking mechanism" is a mechanism being used for changing the relative position or orientation of the hand levers without any movement of the relative position or orientation of the crimping jaws. By use of the locking mechanism the overall closing movement of the crimping jaws might be divided in a plurality of partial closing movements with the same relative movement of the hand levers. One example of such a locking mechanism might be taken from U.S. Pat. No. 7,155,954.

As one option covered by the present invention, the crimping process of the work piece under use of the inventive crimping pliers comprises more than 10, in particular more than 15 or 20, crimping steps secured by the forced locking mechanism.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
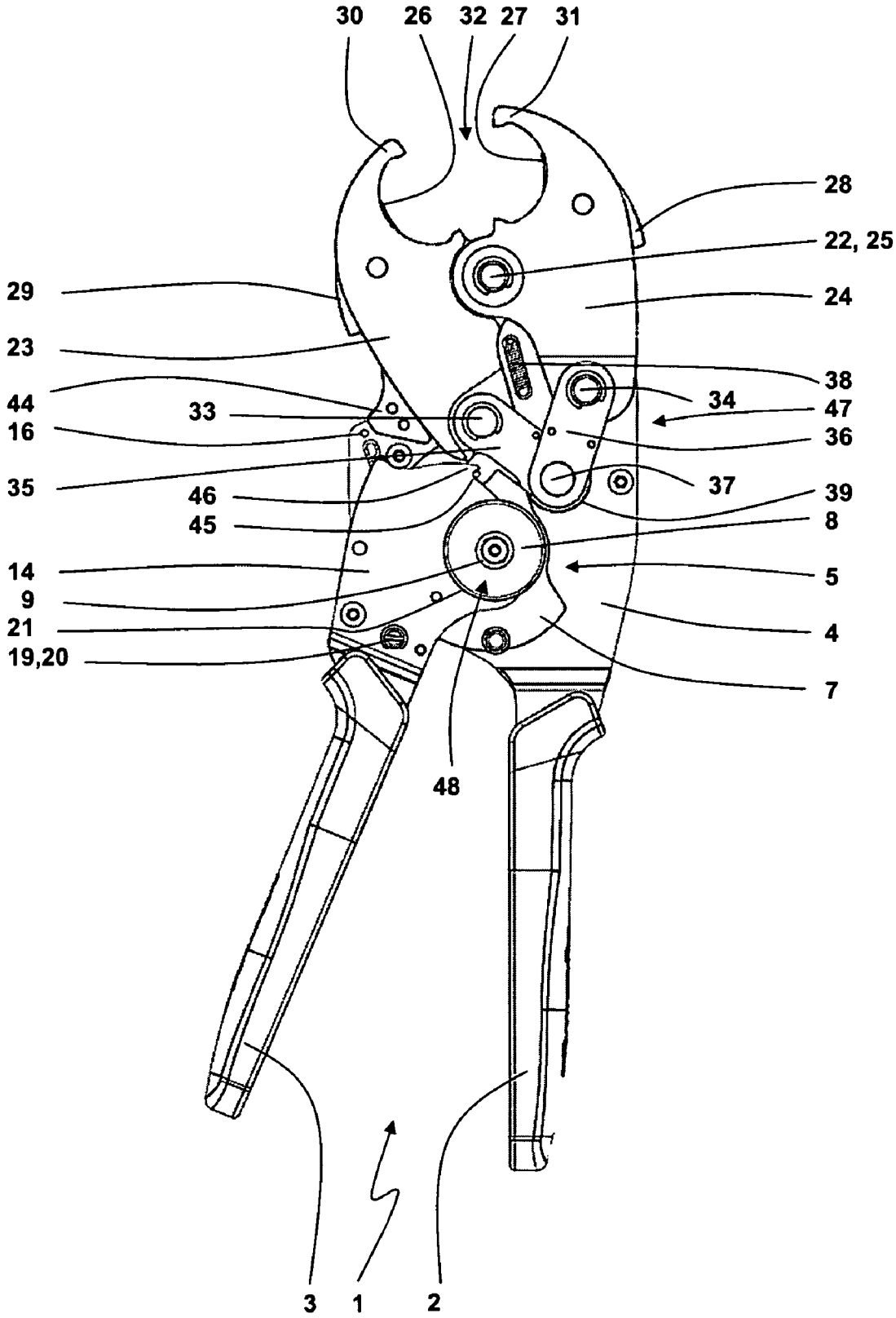
FIG. 1 is a top view showing inner components of crimping pliers according to the invention.

Referring now in greater detail to the drawings, FIG. 1 illustrates crimping pliers 1 having two hand levers 2, 3. Hand lever 2 is fixedly connected with a supporting plate 4. Supporting plate 4 is used for fixing or pivotably supporting further elements of the crimping pliers 1. An activation unit 5 is pivotably linked with supporting plate 4. In the activation unit 5 a pinion gear 6, a cam disc 7 and a pinion gear 8 are positioned one above the other and fixedly linked by means of pivoting bolt 9. Pivoting bolt 9 is oriented perpendicular to the drawing plane according to FIG. 1. The pivoting bolt 9 is linked with the supporting plate 4 with a rotational degree of freedom along its longitudinal axis. Such pivoting degree of freedom might be provided by a through hole of the supporting plate 4 and a corresponding through hole of another supporting plate 10 located at the opposite side but not shown in FIG. 1.

Figure 2:
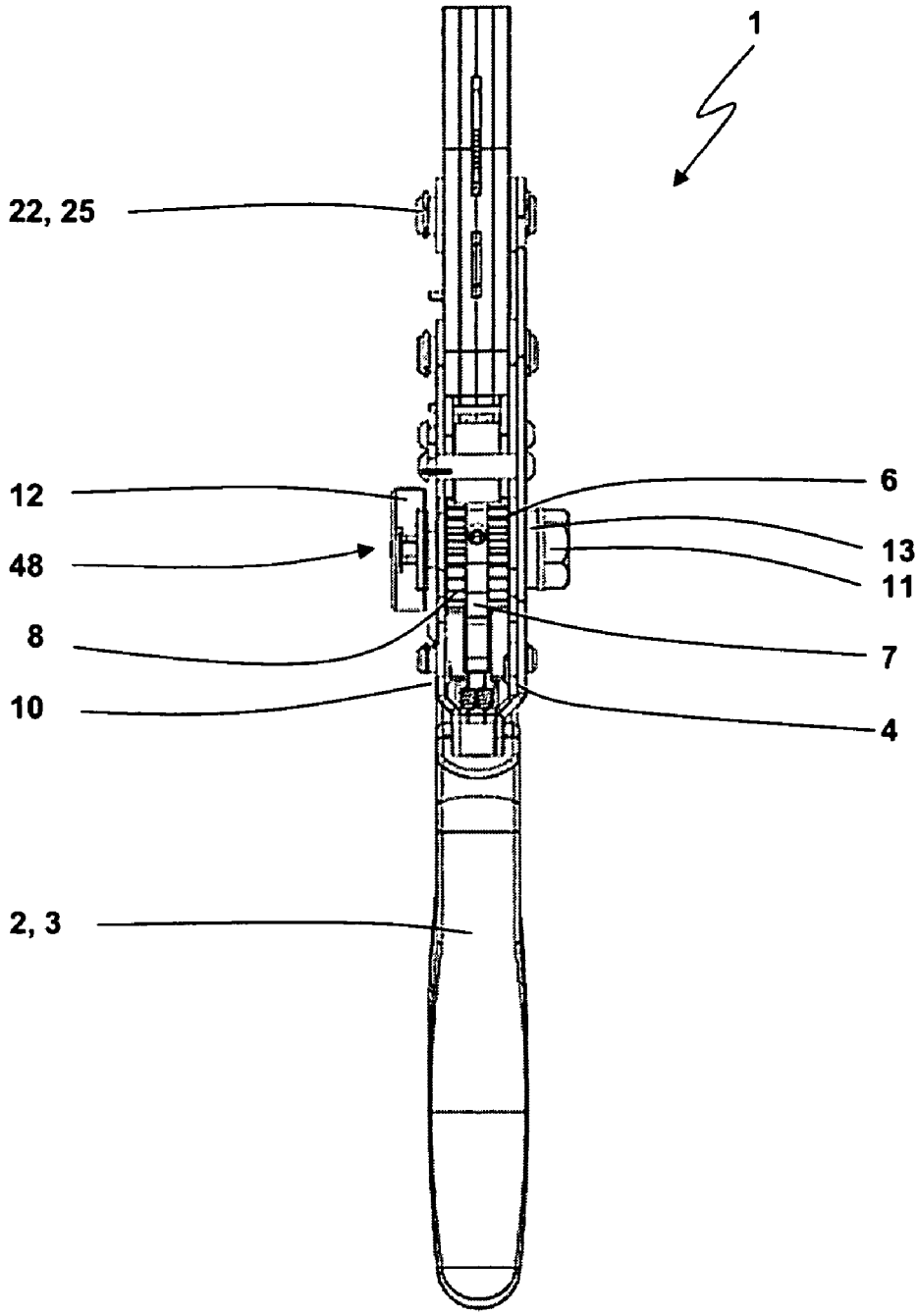
FIG. 2 is a lateral view of crimping pliers according to FIG. 1 (in a completed assembling state).

As can be seen in FIG. 2, the pivoting bolt 9 protrudes at the opposite sides of the supporting plates 4, 10. In one end region the pivoting bolt is secured by means of a nut 11. At the opposite end region the pivoting bolt s fixedly linked with an activation element 12, here an activation disc. Between nut 11 and supporting plate 4 and/or activation element 12 and supporting plate 10 a disc 13 made of nylon might be interposed. By means of the induced friction and the normal force acting upon the disc 13 the torsional moment or force necessary to rotate the activation element 12, pivoting bolt 9, pinion 6, 8, cam disc 7 and nut 11 being part of activation unit 5 might be dimensioned.

Hand lever 3 is fixedly connected with a supporting plate 14. Hand lever 3 comprises a through hole for pivotally linking hand lever 3 with supporting plate 14 with pivoting bolt 9, supporting plate 4 and hand lever 2. Both supporting plate 4 and supporting plate 14 comprise a pin 15, 16 fixedly housed in a bore. These pins 15, 16 are used for suspending one base of a spring 17. The position of the pins 15, 16 is chosen such that the tension and spring force of spring 17 results in the hand levers, 2, 3 without forces applied by the user being spread apart. Forces applied by the user with the related movement of the hand levers towards each other lead to an increased bias of spring 17.

Figure 4:
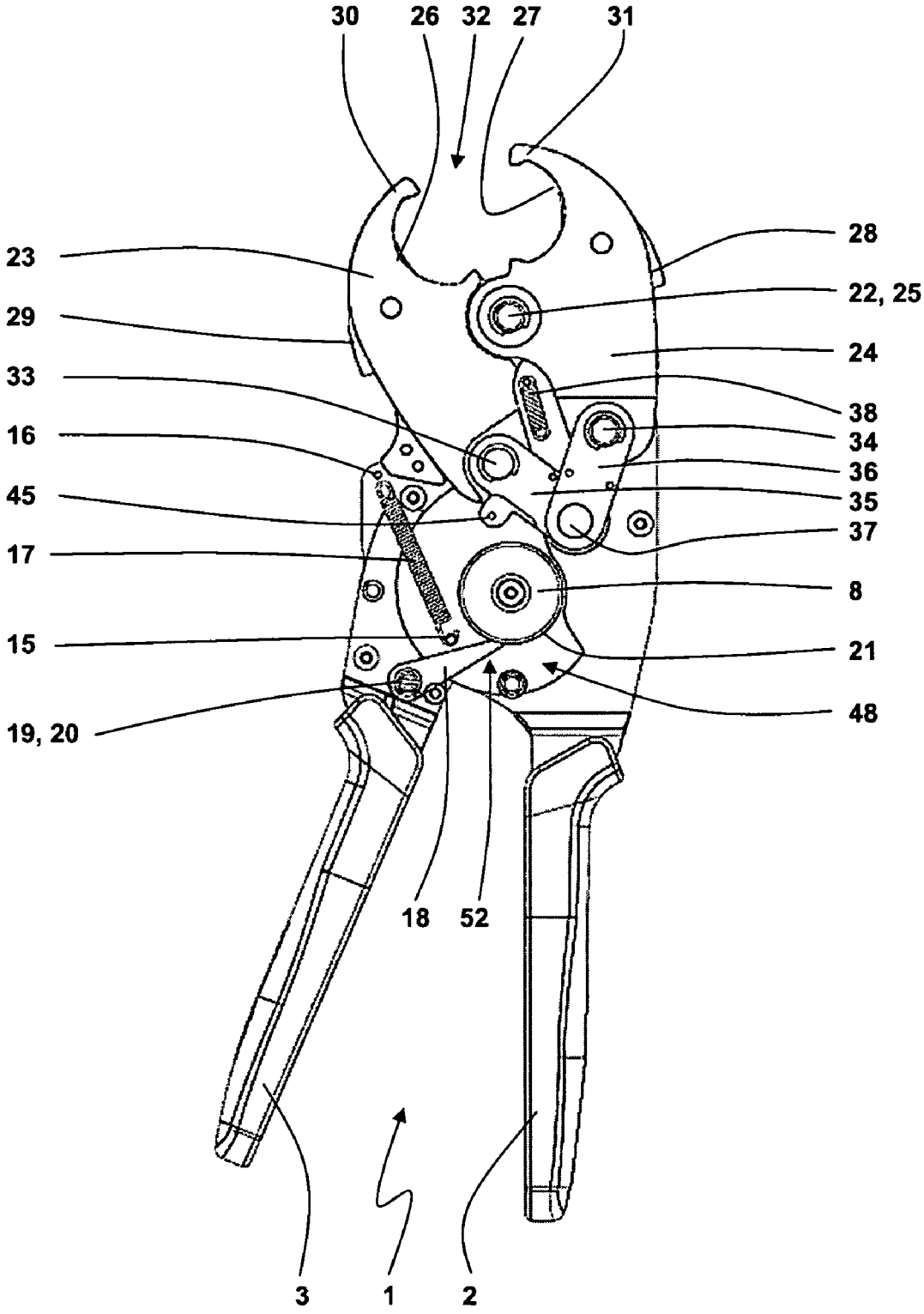
FIG. 4 is a top view or the pliers according to FIGS. 1 to 3 in an open state.
Figure 5:
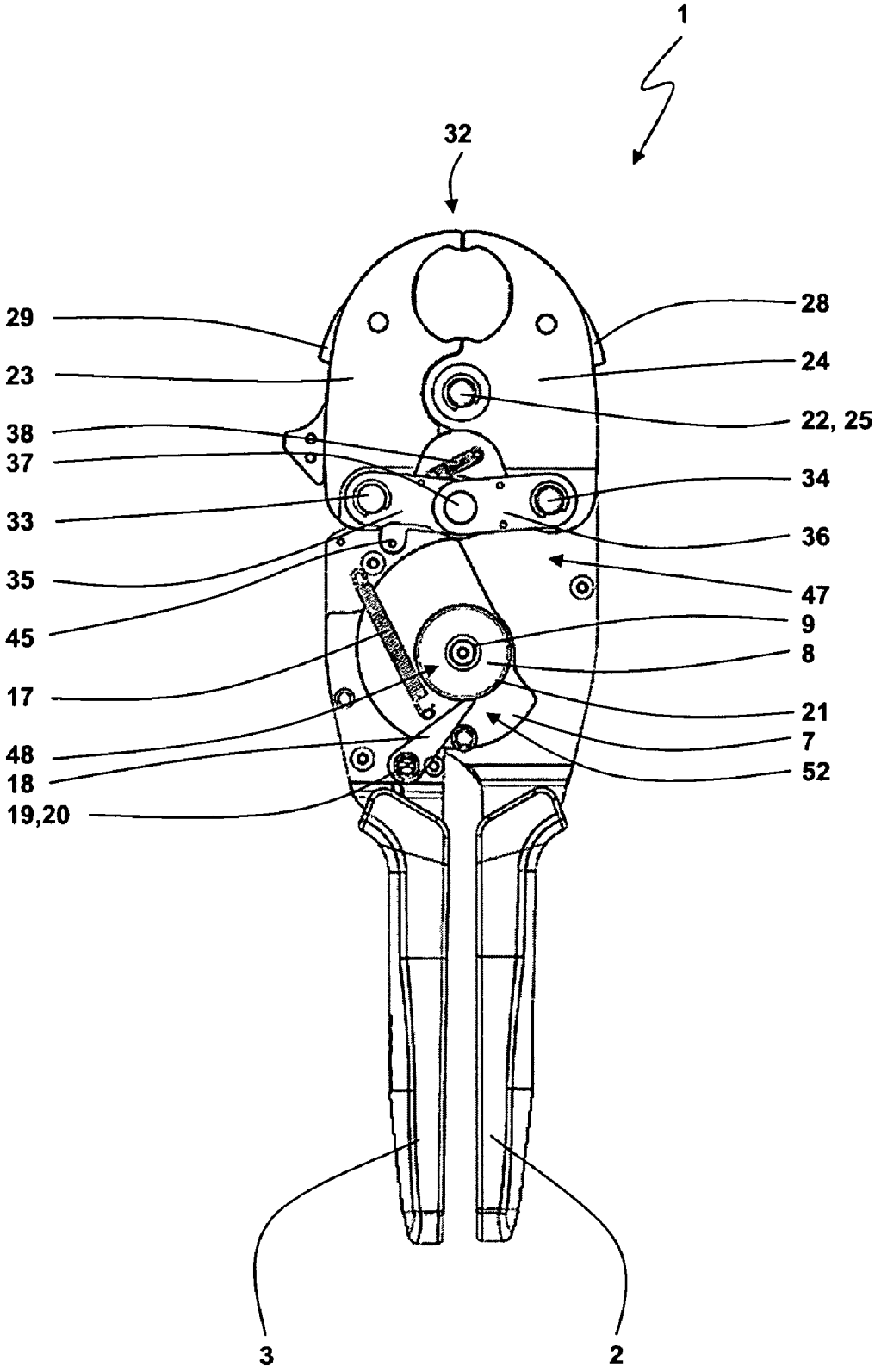
FIG. 5 is a top view of the crimping pliers according to FIGS. 1 to 4 in a closed state.

In the transitional region of the supporting plate 14 to the hand lever 3 supporting plate 14 holds a resting lever 18 which is pivoted around an axis vertical to the drawing plane of FIG. 4. The resting lever 18 extends to the outer circumference of the pinion 8 and is pressed by means of a torsional spring element (which is not shown in the figures) against the outer circumference of pinion 8. In the position shown in FIG. 4 the resting lever 18 has an orientation approximately tangential to the pinion 8. For the shown embodiment, the resting lever 18 is fixedly connected with a pivoting bolt 19 which is pivotably linked with the supporting plate 14. The pivoting bolt 19 comprises a manipulation area 20 located externally from the supporting plate 10. Manipulation of the manipulation area 20 in clockwise direction in FIG. 4 leads to a pivoting movement of the pivoting bolt 19 with resting lever 18 biasing the torsional spring element and moving the resting lever 18 away from pinion 8 for unlocking the locking connection between resting lever 18 and pinion 8. For the embodiment shown in FIG. 4, the activation area 20 is a slit for a screwdriver. Without manual activation of the activation area 20 by the user the resting lever 18 returns into the position shown in FIG. 4. In such position resting lever 18 contacts the outer circumference of pinion 8.

Pinion 8 has teeth 21 at its outer circumference cooperating with the front surface of resting lever 18 as follows:

- In a resting or locking position the tip or front surface of resting lever 18 enters into the space between adjacent teeth. Such positive locking locks the rotation of pinion 8 and the whole activation unit 5 in one direction.
- However, the tip or front surface of resting lever 18 for a pivoting movement of hand lever 3 versus hand lever 2 contacts a tooth profile of an adjacent tooth. Accordingly forces applied by the user upon hand lever 3 are transferred via the pivoting bolt 19, a longitudinal force within resting lever 18 to the tooth profile resulting in a pivoting movement of pinion 8 so that the whole activation unit 5 is pivoted in counter-clockwise direction.
- A manual pivoting movement of hand lever 3 away from hand lever 2 (or such a movement activated by spring 17) results in the resting lever sliding in clockwise direction on the bottom according to FIG. 4 along the teeth 21 passing one or a plurality of teeth. At the end the resting lever enters into the space between other teeth building a secured position against a rotation into the opposite direction.

Accordingly, on the basis of successive opening and closure of the hand levers 2, 3 in a plurality of partial movements or steps a rotation of the activation unit 5 is caused. A reverse movement of the activation unit 5 together with pivoting the hand levers 2, 3 apart and with the movement of the resting lever 18 in clockwise direction is avoided by means of the friction between the activation unit and the support plates 4, 10, e.g. under use of the friction determining disc 13.

A pivoting bolt 22 is housed in coaxial bores in the supporting plates 4, 10. The pivoting bolt 22 is used for supporting two crimping jaws 23, 24 for allowing a pivoting movement around an axis determined by the longitudinal axis of the pivoting bolt 22. Such pivoting axis has an orientation perpendicular to the drawing plane of FIG. 4. The crimping jaws 23, 24 in a first approximation might be described as T-shaped in their top view. A pivoting joint 25 built with the pivoting bolt 22 is located in the end region of the longitudinal leg of the T opposite to the transverse leg. The end regions of the crimping jaws 23, 24 overlap in the pivoting joint 25. The outer end region of the transverse leg of the T of the crimping jaws 23, 24 has an approximately semi-circular housing 26, 27 for a semi-die used for shaping the work piece. Semi-dies might be housed in the housings 26, 27 and locked therein and might be in generally known manner unlocked and/or thrown off the crimping jaws 23, 24 by manual activation of two activating elements 28, 29. The outer limits 30, 31 build a kind of "mouth" 32, wherein the opening width of the mouth 32 decreases with the closing movement of the crimping jaws 23, 24. The work piece might be introduced between the crimping jaws 23, 24 or the semi-dies through the mouth 32. The end regions of the transverse leg of the T of the crimping jaws 23, 24 located opposite to the limits 30, 31 are pivotably linked via the pivoting joints 33, 34 with the end regions of toggle levers 35, 36. The toggle levers 35, 36 are pivotably linked in their abutting end regions via a toggle lever joint 37. For the shown embodiment, the pivoting joints 33, 34 as well as the toggle lever joint 37 are built with bearing bolts oriented perpendicular to the drawing plane according to FIG. 4. The bearing bolts are housed in corresponding bores of the related elements. One base of a pulling spring 38 is supported by the supporting plates 4, 10, whereas the other base of the pulling spring 38 is supported by the related toggle lever 35, 36 or the toggle lever joint 37. The pulling spring 38 is preloaded and has an orientation such that the pulling force biases the toggle levers 35, 36 versus their coaxial orientation. Such bias means that the pulling force 38 presses the crimping jaws 23, 24 in closing direction. Rotatably linked with the toggle lever joint 37 is a roller 39 located in the plane of the cam disc 7.

During a pivoting movement of the activation unit 5 the roller 39 rolls along the contour 40 of the cam disc 7. According to the change of the contour 40 the toggle lever joint 37 is displaced, i.e. an increase of the distance of the contour 40 from the pivoting bolt 9 leads to displacing the toggle lever joint 37 versus the pivoting bolt 22. The contour 40 of the cam disc 7 comprises a "spiral-shaped" crimping region 41. In the crimping region 41 continued rotation of the activation unit 5 continuously decreases the distance of the contact area between contour 40 and roller 39 from the rotational axis of the cam disc 7. A closing state 42 is reached when the roller 39 approaches the end of the crimping region 41. For further rotation of the cam disc 7, contour 40 of the cam disc 7 gets out of contact with the roller 39 which is due to the remaining free region 43. Accordingly, in case of rotating the activation unit 5 further than the closing state 42 the closing or crimping force transferred from the cam disc 5 to the toggle lever joint 37 via roller 39 is removed. However, the force of the pulling springs 38 acts in closing or crimping direction. By manually opening the crimping jaws 23, 24, e.g. by means of the activation element 44, it is possible to open the crimping jaws 23, 24. Pin 45 is oriented perpendicular to the drawing plane according to FIG. 1 and fixedly housed in a bore of a protrusion of the toggle lever 35. With increasing distance of the crimping jaws, pin 45 moves versus a stop element. Such stop element is built by a front region of the supporting plate 14 of hand lever 3. The stop element avoids that in the open state the crimping jaws are closed by the pulling spring 38. Pin 45 and stop element 46 are disengaged for another closing movement from the open state by pivoting hand lever 3 versus hand lever 2. As soon as stop element 46 is overcome or removed, the pulling spring 38 causes a closing movement of the crimping jaws 23, 24 bringing the crimping jaws 23, 24 automatically in contact with the outer circumference of the work piece. Here, the contact pressure of the crimping jaws 23, 24 at the outer circumference of the work piece depend on the stiffness of the pulling force 38. It is possible that roller 39 moves away from the contour 40 of the cam disc 7. This is due to the fact that the contact pressure in such case is not caused by contact forces of the contour 40 contacting the roller 39 but caused by the pulling spring 38.

For alternative embodiments instead of the shown engagement between pin 45 and stop element 46 any other suitable locking unit or resting unit might be used that could be manually activated and unlocked by the user or might be activated or unlocked according to the shown embodiment by simple manipulation of the hand levers 2, 3.

From the closed state shown in FIG. 1 with the pin 45 being in contact with stop element 46 the crimping jaws 23, 24 might be manually opened by manually pulling crimping jaws 23, 24 apart. During such movement pin 45 moves away from stop element 46 and moves along a guiding front surface 53 of supporting plate 14. During such movement from the open state to the loading state the free region 43 does not block a movement of the toggle lever joint 37 away from pivoting bolt 22.

For crimping a work piece crimping pliers 1 are used as follows:

Starting from the open state shown in FIG. 1, first the crimping jaws 23, 24 are manually transferred into the further opened loading state. In such loading state the work piece might be introduced between the crimping jaws through mouth 32. When removing the manual forces with the work piece located between the crimping jaws the pulling spring 38 closes the crimping jaws 23, 24, until the open state according to FIG. 1 is reached. Such open state is secured against further closure of the crimping jaws 23, 24 via pin 45 and the stop element 46. However, it is also possible that the work piece without transfer of the crimping pliers into the loading state is introduced between the crimping jaws 23, 24 in the open state. With a simple manipulation of the hand levers 2, 3 the pin 45 passes stop element 46. As a consequence, pulling spring 38 is able to pull the toggle lever joint 37 in forward direction correlating with a movement of the crimping jaws 23, 24 versus each other so that the work piece is clamped between the crimping jaws 23, 24. The aforementioned movement leads to a small increase of the distance of the roller 39 from the contour 40 of the cam disc 7. Subsequently, the cam disc 7 is manually rotated, so that the roller 39 comes into contact with the crimping region 41 of the contour 40 of the cam disc 7. Also a partial movement 49 of the crimping region 41 might be caused by manual rotation of the activation unit 5. At the end of the manual rotation of the activation unit 5 any reached position at the contour 40 might be secured by means of the engagement of the pinion 8 and rest lever 18. Now a crimping or further crimping within the partial movement 50 is caused by successive pivoting of the hand levers 2, 3 versus each other. Such pivoting movement is coupled with a rotation of the activation unit 5. Subsequently, the hand levers 2, 3 are automatically spread apart by pulling spring 17. At the end of the crimping region 41 of the cam disc 7 the closed state 42 is reached correlating with the closest position of the crimping jaws 23, 24. Now the crimping process is finished. Further manipulation of the hand levers causes a further rotation of the activation unit, so that the closed state 42 is left. In the free region 43 the activation force applied by the cam disc 7 to the toggle lever joint 37 is removed. Accordingly it is possible that the crimping jaws move away from each other due to an elastic widening of the work piece. However, despite the removed contact between cam disc 7 and roller 39 the pulling spring 38 still presses the crimping jaws 23, 24 against the work piece. For removing the crimping pliers 1 from the work piece it is necessary to manually pull the crimping jaws 23, 24 in opposite directions, until the pin 45 is locked behind stop element 46 so that the secured open state is built. In case of an opening of the crimping jaws 23, 24 further than the open state for removing the work piece a further pivoting movement of the crimping jaws 23, 24 might be caused, so that also the loading state might be reached.

For the shown embodiment, the transfer or transmission mechanism 47 between the hand levers 2, 3 and the crimping jaws 23, 24 comprises the resting lever 18, the activation unit 5 with pinion 8, cam disc 7, toggle lever joint 37 and the toggle levers 35, 36. The transfer or transmission mechanism 47 is used for transferring forces and moments between the hand levers 2, 3 and the crimping jaws 23, 24, for providing a transmission ratio and for determining kinematics of closing the crimping jaws.

For the shown embodiment, on both sides of the cam disc 7 a pinion 8, a resting lever 18 and a pulling spring 17 are located. The forces acting upon the teeth 21, the resting lever 18 and the pulling spring 17 divide. Furthermore, such design leads to a symmetric force transfer in the transfer or transmission mechanism 47.

Figure 3:
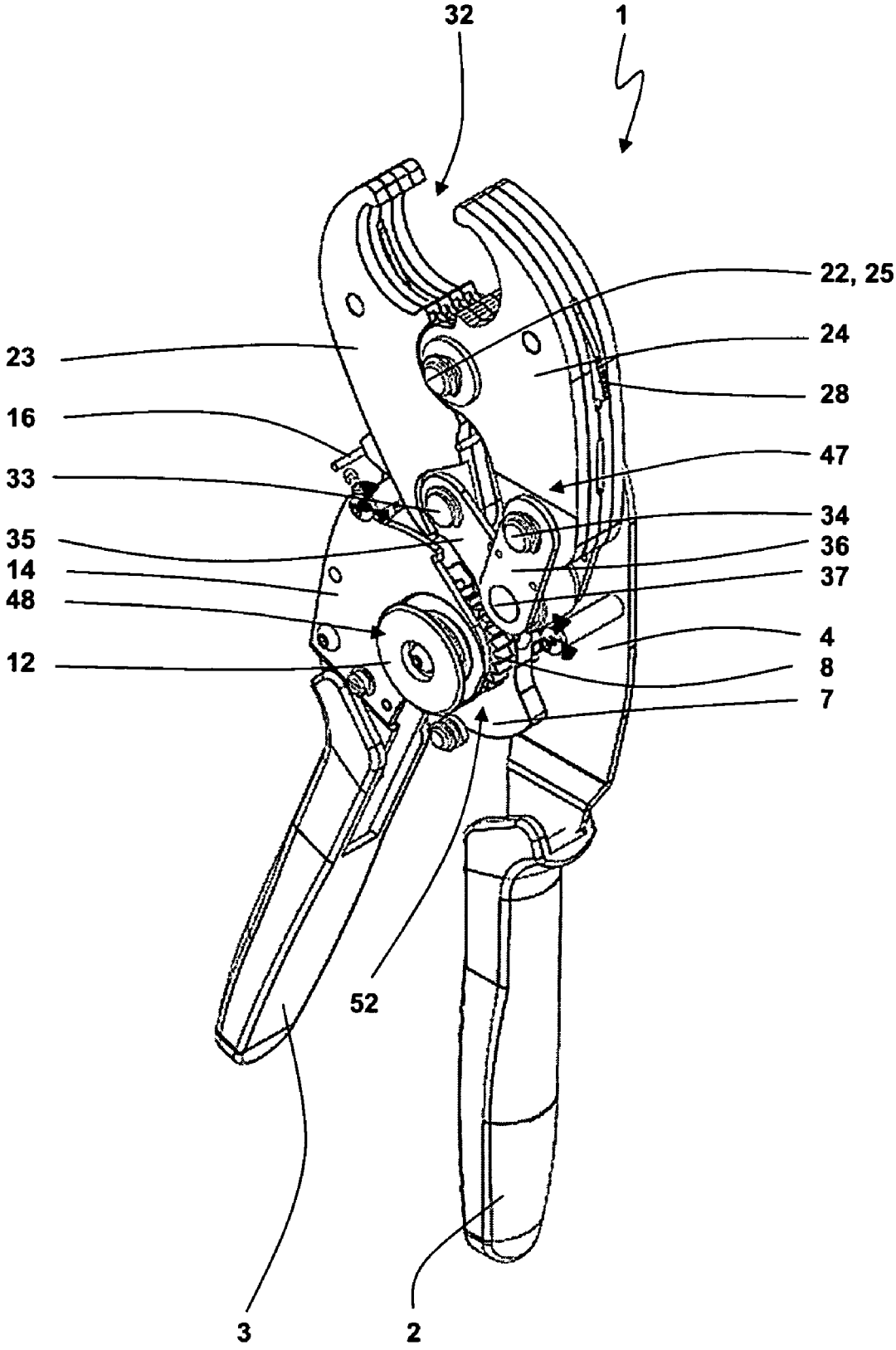
FIG. 3 shows components of the pliers according to FIGS. 1 and 2 in a three-dimensional view.
Figure 6:
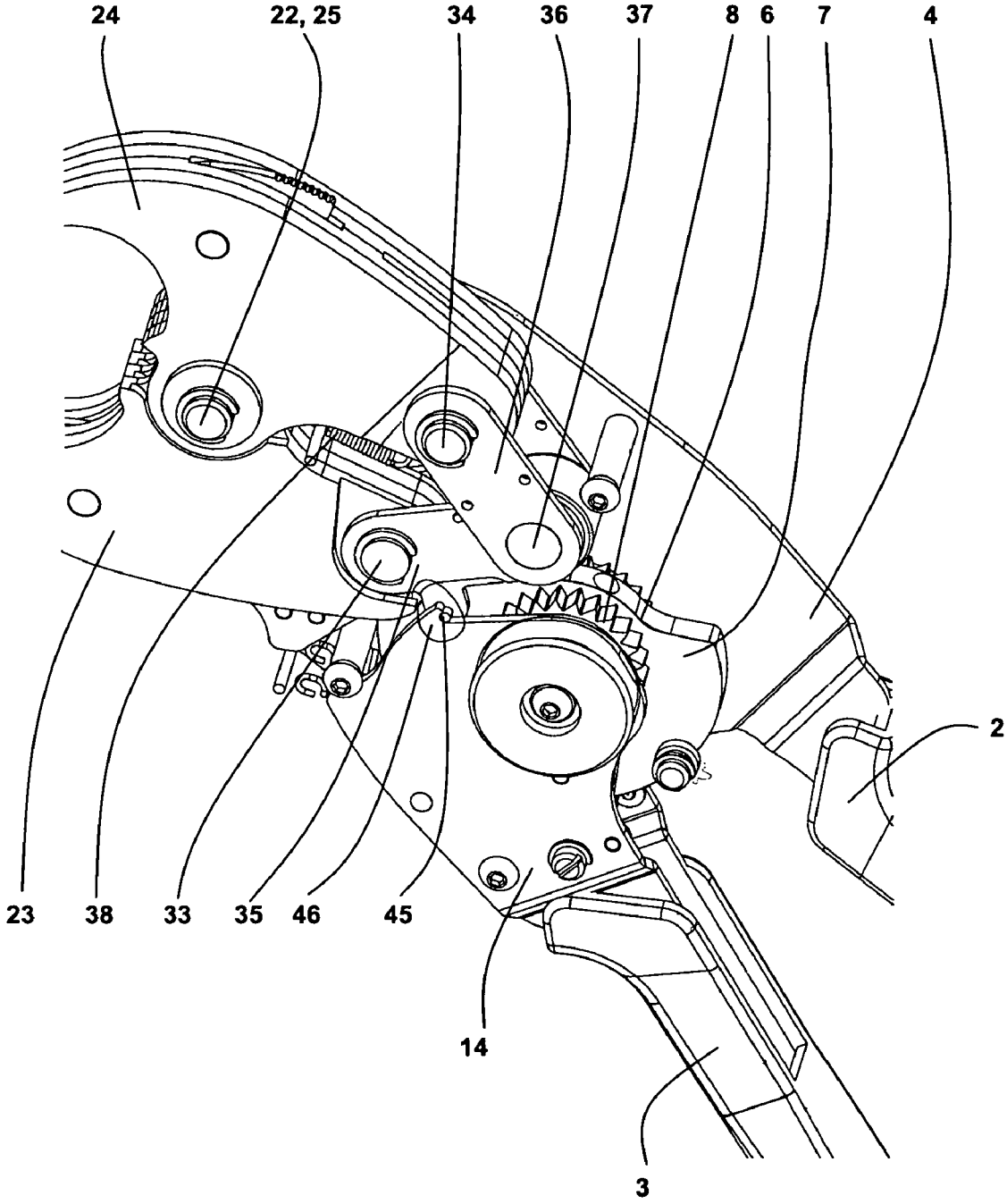
FIG. 6 shows components of the inventive crimping pliers according to FIGS. 1 to 5 in an enlarged three-dimensional view.
Figure 7:
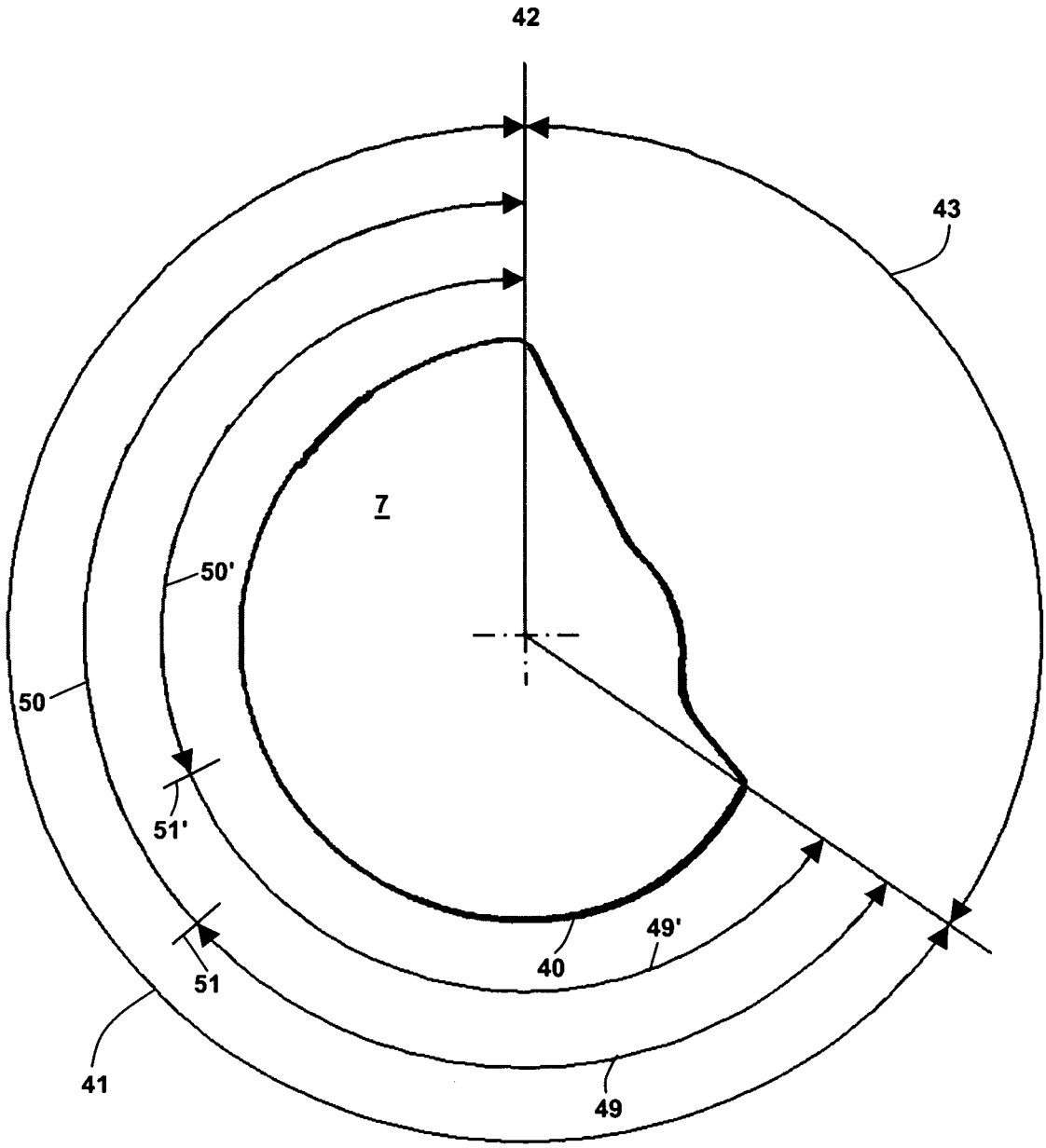
FIG. 7 shows a cam disc appropriate for use in crimping pliers according to FIGS. 1 to 6.
Figure 8:
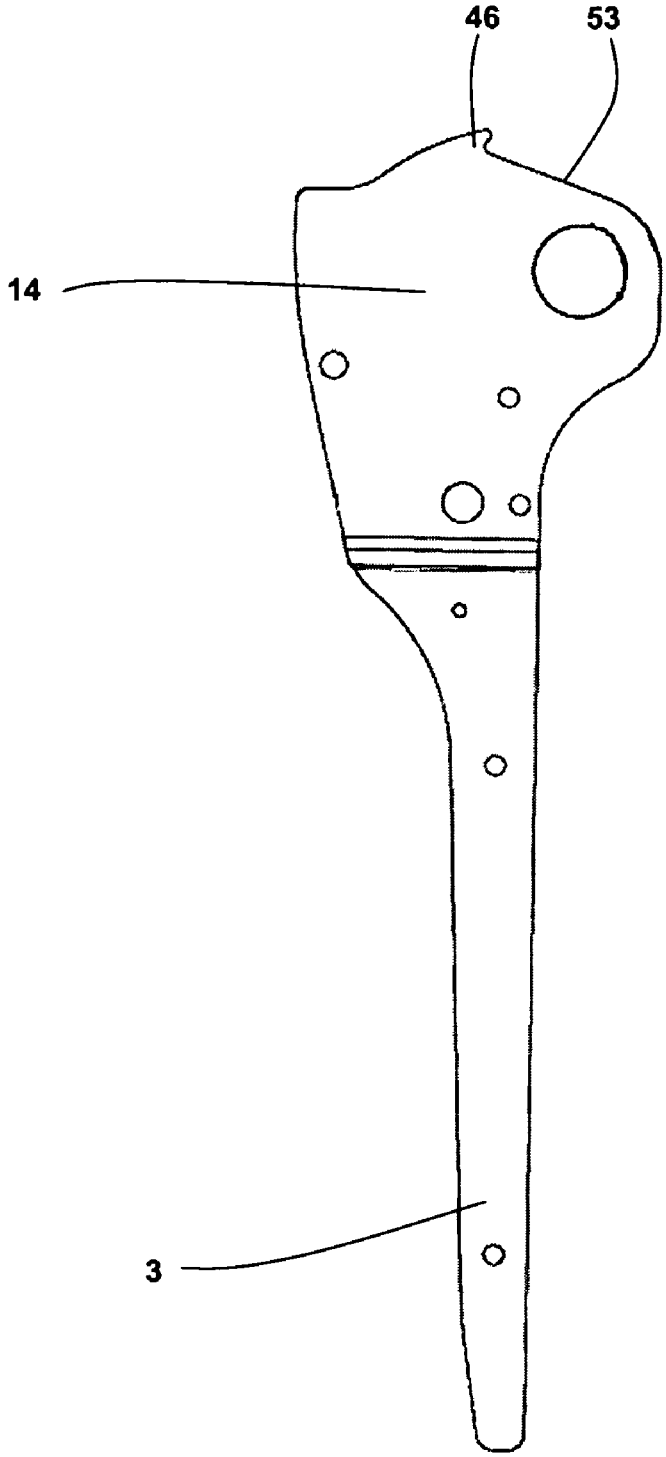
FIG. 8 shows a hand lever with a fixedly connected supporting plate being used in the crimping pliers according to FIGS. 1 to 6.

As can be seen in FIGS. 2, 3 and 6, the main components of the crimping pliers 1 have a plate-like design.

A closing mechanism 48 is built with the activation unit 5. The activation unit 5 is manually activated and acts via the toggle lever joint 37 and the toggle levers 35, 36 on the crimping jaws 23, 24 for causing the closing movement.

It is possible that the closing mechanism 48 by manual activation of the activation unit 5 causes a movement of the crimping jaws 23, 24 towards each other in a partial movement 49, whereas in the subsequent partial movement 50 the main crimping process is caused by means of activation of the hand levers 2, 3. For the shown embodiment in the partial movements of the closing process the closing might be activated by manual activation of the activation unit 5 and the closing mechanism 48 or by manual activation of the hand levers. For the transition from the partial movement 49 to the partial movement 50, so for the start of the manipulation of the hand levers, a starting state 51 is reached. For another crimping process the partial movement 49' might be shorter or longer leading to a different starting state 51'. The cooperation between resting lever 18 and teeth 21 and the bias of the pulling spring 17 builds a ratchet-mechanism 52 or a locking mechanism.

The shown embodiment of the crimping pliers is only one possible embodiment. The disclosed inventive features might partially or completely be integrated into other types of crimping pliers, in particular those described in the patent applications and patents of the applicant. To give some examples, the features of the invention might be used for pliers of the following types:

DE 40 23 337 C1, DE 44 27 553 C2, DE 198 32 884 C1 and DE 100 56 900 C1 show pliers having dies being closed by a translational movement, wherein in some embodiments the dies are guided by an O-shaped guiding frame.

Pivotable crimping jaws for cable connectors being introduced transverse to the main plane of the pliers are disclosed in DE 37 08 727 C2 or DE 199 24 087 C2. Similar pliers, here used for cable shoes, are described in DE 197 09 639 A1. Also DE 198 02 287 C1 discloses pliers with pivotable crimping jaws.

The invention might also be applied for crimping pliers with a C-shaped head of the pliers. The crimping jaws or dies are displaced between the transverse legs of the C, see DE 102 42 345 B3 and DE 197 13 580 C2. DE 197 53 436 C2 shows the option of designing the pliers with a C-shaped head or with pivotable crimping jaws.

DE 40 26 332 C2 discloses crimping pliers wherein the work piece is introduced from the front surface of the pliers in longitudinal direction of the pliers between the jaws or dies.

Examples of forced locking mechanisms for different types of pliers also suitable for cumulative use with the present invention are described in DE 101 40 270 B4, DE 40 39 435 C1, DE 198 07 737 C2, DE 197 13 580 C2, DE 198 34 859 C2, DE 197 09 639 A1 and DE 199 24 086 C2.

DE 198 32 884 C1 discloses pliers with a locator used for positioning the work piece relative to the head of the pliers.

Crimping pliers with kinematics being adaptive by changing the linking point of a pressure rod in a toggle lever mechanism is known from DE 198 34 859 C2.

DE 199 63 097 C1 discloses a design with a hand lever having two parts. The angle between the two parts is adjustable for providing different opening angles of the outer part of the hand lever relative to the other hand lever for the same position of the crimping jaws.

A cam drive mechanism, here for cutting pliers, is known from DE 101 32 413 C2.

A locking mechanism that might be integrated into crimping pliers according to the present invention might be taken from DE 103 46 241 B3.

DE 10 2007 001 235 discloses crimping pliers with three or two hand levers having a switchable transfer or transmission mechanism such that for two partial movements the hand levers might be moved in different directions.

Many variations and modifications may be made to the preferred embodiments of the invention without departing substantially from the spirit and principles of the invention. All such modifications and variations are intended to be included herein within the scope of the present invention, as defined by the following claims.

We claim:

1. Crimping pliers designed and arranged for manually crimping a work piece comprising a) two manually operated hand levers, b) two crimping jaws, c) a transfer mechanism coupling a movement of said hand levers with a movement of said crimping jaws, d) a closing mechanism designed and arranged for being operated independent on said hand levers for the work piece being introduced between said crimping jaws, e) said closing mechanism being arranged and designed such that upon activation of said closing mechanism said crimping jaws are moved from an open state in a partial movement into a further closed starting state, f) said crimping jaws being secured in said starting state against returning into said open state by means of a rest lever engaging a pinion of said transfer mechanism, wherein g) starting from said starting state said crimping jaws being movable in an additional partial movement towards each other upon movement of said hand levers wherein forces applied upon said hand lever are transferred via the rest lever to pinion.

2. Crimping pliers according to claim 1, wherein said closing mechanism comprises a plurality of starting states.

3. Crimping pliers according to claim 2, wherein said closing mechanism is built with a ratchet-mechanism.

4. Crimping pliers according to claim 1, wherein a) said transfer mechanism is built with two toggle levers being linked with each other by a toggle lever joint, wherein at least one of said toggle levers is pivotably linked with one of said crimping jaws in its end region opposite to said toggle lever joint, b) said toggle lever joint is movable along a cam disc wherein a movement of said toggle lever joint along said cam disc coincides with a closing movement of said crimping jaws.

5. Crimping pliers according to claim 3, wherein a) said transfer mechanism is built with two toggle levers being linked with each other by a toggle lever joint, wherein at least one of said toggle levers is pivotably linked with one of said crimping jaws in its end region opposite to said toggle lever joint, b) said toggle lever joint is movable along a cam disc wherein a movement of said toggle lever joint along said cam disc coincides with a closing movement of said crimping jaws.

6. Crimping pliers according to claim 5, wherein said cam disc is coupled with said ratchet-mechanism.

7. Crimping pliers according to claim 4, wherein said cam disc is fixedly connected with an activation element being located at the outer periphery of said crimping pliers.

8. Crimping pliers according to claim 6, wherein said cam disc is fixedly connected with an activation element being located at the outer periphery of said crimping pliers.

9. Crimping pliers according to claim 4, wherein said crimping jaws are movable by a manually activated movement of said crimping jaws from a stable open state into a loading state, wherein in said loading state the crimping jaws have a larger distance from each other than in said stable open state.

10. Crimping pliers according to claim 9, said crimping jaws in said loading state being biased by a spring element versus said open state.

11. Crimping pliers according to claim 9, wherein during a movement of said crimping jaws between said loading state and said open state said toggle lever joint is moved relative to said cam disc.

12. Crimping pliers according to claim 1, wherein one element of the group consisting of a stopping element, a locking unit or a resting unit is provided designed and arranged for avoiding an automatic closing movement of said crimping jaws from said open state.

13. Crimping pliers according to claim 9, wherein one element selected from the group consisting of a stopping element, a locking unit or a resting unit is provided designed and arranged for avoiding an automatic closing movement of said crimping jaws from said open state.

14. Crimping pliers according to claim 12, wherein said element selected from the group consisting of a stopping element, a locking unit or a resting might be disengaged by manual activation of said hand levers.

15. Crimping pliers according to claim 13, wherein said element selected from the group consisting of a stopping element, a locking unit or a resting might be disengaged by manual activation of said hand levers.

16. Crimping pliers according to claim 12, wherein a spring element is provided pressing said crimping jaws against the periphery of said work piece upon deactivation of said element selected from the group consisting of a stopping element, a locking unit or a resting.

17. Crimping pliers according to claim 1, wherein the length of said crimping pliers is smaller than 400 mm.

18. Crimping pliers according to claim 1, wherein the overall transmission ratio between forces applied manually to said hand levers and said crimping jaws is chosen such that crimping forces at said crimping jaws are larger than 20,000 N.

19. Crimping pliers according to claim 1, wherein at least one element selected from the group consisting of a forced locking mechanism and a stop locking mechanism is provided.

20. Crimping pliers according to claim 19, wherein said forced locking mechanism is designed and arranged such that the crimping process is performed with more than 10 crimping steps.

* * * * *